US006577222B1

(12) United States Patent
Krueger et al.

(10) Patent No.: US 6,577,222 B1
(45) Date of Patent: Jun. 10, 2003

(54) FUSE HAVING IMPROVED FUSE HOUSING

(75) Inventors: David J. Krueger, Naples, FL (US); Seibang Oh, Elk Grove Village, IL (US)

(73) Assignee: Littelfuse, Inc., Des Plaines, IL (US)

( * ) Notice: Subject to any disclaimer, the term of this patent is extended or adjusted under 35 U.S.C. 154(b) by 0 days.

(21) Appl. No.: 09/538,188

(22) Filed: Mar. 30, 2000

Related U.S. Application Data

(60) Provisional application No. 60/127,658, filed on Apr. 2, 1999.

(51) Int. Cl.[7] ..... H01H 85/17; H01H 85/175; H01H 85/08

(52) U.S. Cl. ..... 337/246; 337/273; 337/187; 337/180; 337/228

(58) Field of Search ..... 337/159, 180, 337/186, 187, 227, 228, 246, 273

(56) References Cited

U.S. PATENT DOCUMENTS

| | | | | | |
|---|---|---|---|---|---|
| 3,983,525 | A | * | 9/1976 | Healey, Jr. | 337/186 |
| 3,984,800 | A | | 10/1976 | Healey, Jr. | 337/186 |
| 3,986,158 | A | | 10/1976 | Salzer | 337/246 |
| 4,023,265 | A | * | 5/1977 | Aryamane | 29/623 |
| 4,068,204 | A | | 1/1978 | Iwanari et al. | 337/408 |
| 4,131,869 | A | * | 12/1978 | Schmidt, Jr. et al. | 337/264 |
| 4,164,725 | A | | 8/1979 | Wiebe | 337/198 |
| 4,373,555 | A | | 2/1983 | Mattuck et al. | 138/140 |
| 4,563,666 | A | * | 1/1986 | Borzoni | 337/252 |
| 4,635,023 | A | * | 1/1987 | Oh | 337/264 |
| 4,755,785 | A | | 7/1988 | Bernstein | 337/186 |
| 4,918,420 | A | * | 4/1990 | Sexton | 337/205 |
| 4,943,248 | A | | 7/1990 | Colleran et al. | 439/850 |
| 4,947,149 | A | | 8/1990 | Pimpis et al. | 337/246 |
| 5,130,688 | A | | 7/1992 | Van Rietschoten et al. | 337/231 |
| 5,294,905 | A | | 3/1994 | Pimpis | 337/158 |
| 5,296,833 | A | | 3/1994 | Breen et al. | 337/297 |
| 5,420,561 | A | * | 5/1995 | Swensen | 337/365 |
| 5,648,750 | A | | 7/1997 | Yuza et al. | 337/295 |
| 5,713,124 | A | | 2/1998 | Jackson | 29/623 |
| 5,736,919 | A | * | 4/1998 | Reeder | 337/227 |

FOREIGN PATENT DOCUMENTS

| | | |
|---|---|---|
| DE | 2714797 A1 | 2/1979 |
| EP | 0302568 A2 | 2/1989 |
| EP | 0621621 A3 | 10/1994 |
| EP | 0621621 A2 | 10/1994 |

* cited by examiner

*Primary Examiner*—Anatoly Vortman
(74) *Attorney, Agent, or Firm*—Bell, Boyd & Lloyd LLC

(57) ABSTRACT

A fuse is disclosed having terminal leads electrically connected by a fusible link, and insulated within a housing. The housing is preferably made from a material which burns cleanly and has improved ablative qualities to prevent accelerated arcing within the plasma generated by the housing during high energy periods. The desired material should have an arc resistance of about 60 to about 120 seconds, a CTI of about 250 to about 400 volts, an arc ignition resistance of greater than 120 arcs, an arc tracking rate of about 25 to about 80 millimeters per minute, and a hot wire ignition value of greater than 120 seconds. Such material being capable of increasing the voltage rating of a standard 32 volt fuse almost ten-fold to about 300 volts.

28 Claims, 3 Drawing Sheets

FIG. 1
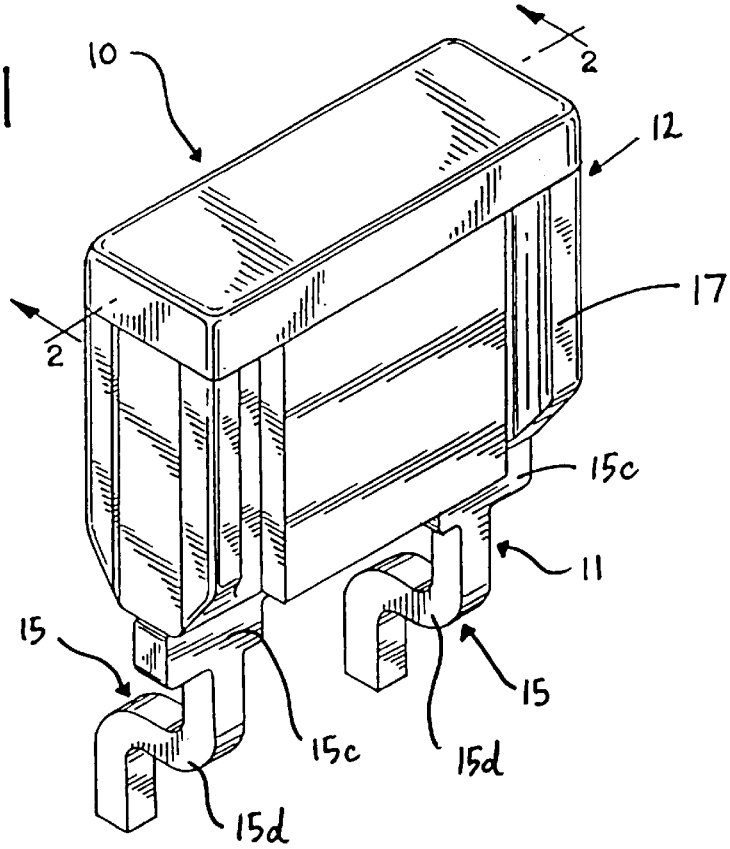
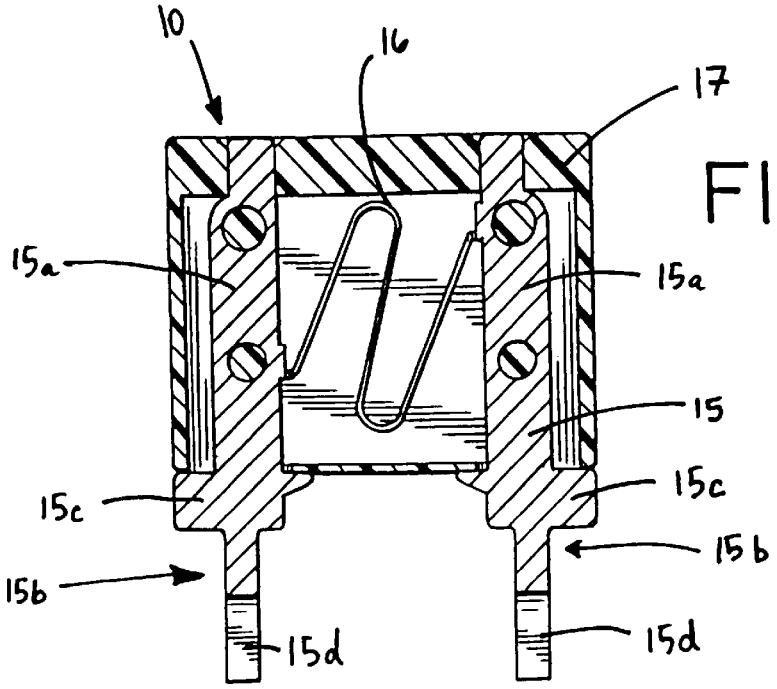
FIG. 2

FUSE HAVING IMPROVED FUSE HOUSING

CROSS REFERENCE TO RELATED APPLICATIONS

This application claims the benefit of U.S. Provisional Application Ser. No. 60/127,658, filed Apr. 2, 1999.

TECHNICAL FIELD

The present invention relates to a surface-mountable fuse having an outer insulative housing. More particularly, the present invention relates to a fuse having an outer housing made from a material which improves the overall current rating of the fuse.

BACKGROUND OF THE INVENTION

Fuses are used to conduct current under normal conditions and to break a circuit under overload conditions. Many electrical fuses, including the fuses employed in automotive vehicles, comprise a pair of generally terminal leads which are electrically connected to one another. The electrical connection between the terminal leads of the fuse is selected in accordance with the specified current to be carried by the circuit into which the fuse is incorporated. An electrical current level which exceeds the specified level—the overload condition—will damage the electrical connection between the terminal leads of the fuse, thereby breaking the circuit and preventing more serious damage to other electrical components.

In some fuses, an insulative housing is used to contain heat and provide for quick melting of the fusible elements under overload conditions. The most suitable and most widely used materials for the housings of electric fuses are flame-retardant polymers, ceramic materials, and synthetic-glass-cloth laminates. It is common for these materials to contain a halogenated material for increased flame retardation. However, under high-voltage conditions when a great deal of heat is generated within the fusible elements of the fuse, prior art housings vaporize to form an ion plasma—a process called ablating. This process involves arcing within the resultant plasma, which is further increased by the presence of halogen ions (from the flame retardant material).

In prior art fuses, the specific current rating of any fuse (the threshold current beyond which the fusible connection will break) is substantially determined by the amperage capacity of the fusible connection. In other words, to increase the rating of the fuse, one would increase the amperage capacity of the fusible connection. The present invention breaks from this convention and provides for a higher rated fuse by constructing the insulative housing from a specific material.

By providing a low-voltage fuse with a housing made from a material which (1) burns cleanly, (2) has greater ablative qualities over other fuse housing materials, and (3) resists ignition at high-voltage energies, a higher-voltage electric fuse is produced without increasing the amperage capacity of the fusible connection.

SUMMARY OF THE INVENTION

The present invention discloses an electric fuse having an insulative housing, two terminal leads extending from the housing, and a fusible link electrically connecting the two terminal leads. The insulative housing is made from a material that increases the overall rating of the fuse. In accordance with the increased current rating, the housing of the present fuse electrically insulates the fusible link and is preferably made from a material which burns cleanly and has improved ablative qualities. The housing material, therefore, produces little or no carbon tracking, and any plasma of the housing material generated in high energy periods does not accelerate arcing. It is preferred that the housing material should be free of halogens, which when ionized accelerate arcing within a plasma. Preferred insulative materials (e.g., nylon and PET polyester) increase the current rating of fuses according to the present invention by as much as ten times the current rating of electrical fuses having a conventional polysulfone housing.

In one embodiment of the present invention, the material used for the fuse housing has an arc resistance within the range of about 60 to about 120 seconds. The housing may be made from a material having a comparative tracking index within the range of about 250 to about 400 volts. The housing material used may also have a high-amperage arc ignition resistance of greater than 120 arcs. Additionally, the material may have a high-voltage arc tracking rate within the range of about 25 to about 80 mm/minute, and a hot wire ignition value of greater than 120 seconds. It is preferred that the material used for the fuse housing should meet or exceed each of these target electrical and flammability values.

BRIEF DESCRIPTION OF THE DRAWINGS

In the drawings:

FIG. 1 is perspective view of one embodiment of a fuse according to the present invention;

FIG. 2 is a cross-sectional view of the embodiment shown in FIG. 1 taken along lines 2—2 and showing a fusible link electrically connecting two terminal leads to one another;

DETAILED DESCRIPTION OF A PREFERRED EMBODIMENT

Figure 3:
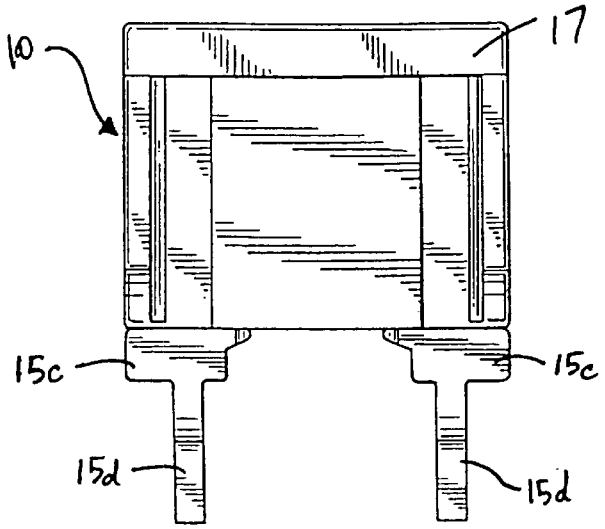
FIG. 3 is front plan view of the embodiment shown in FIG. 1.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Specifically, FIGS. 1–7 show a surface-mountable fuse 10 according to the present invention. The fuse 10 has a conductive component 11 and an insulative component 12. The conductive component 11 comprises two terminal leads 15, and a fusible link 16 which electrically connects the two leads 15. The insulative component 12 comprises a housing 17. Each terminal lead 15 is comprised of proximal end portion 15*a* positioned within the housing 17, and a distal end 15*b* extending outwardly from openings in the bottom of the housing 17. As best illustrated in FIG. 1, the distal end 15*b* of the terminal leads 15 are configured to make the fuse 10 surface-mountable.

Figure 4:
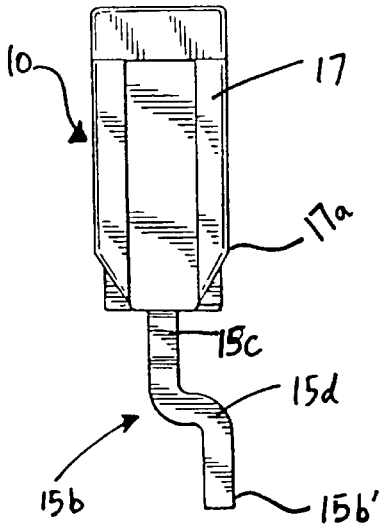
FIG. 4 is side plan view of the embodiment shown in FIG. 1.
Figure 5:
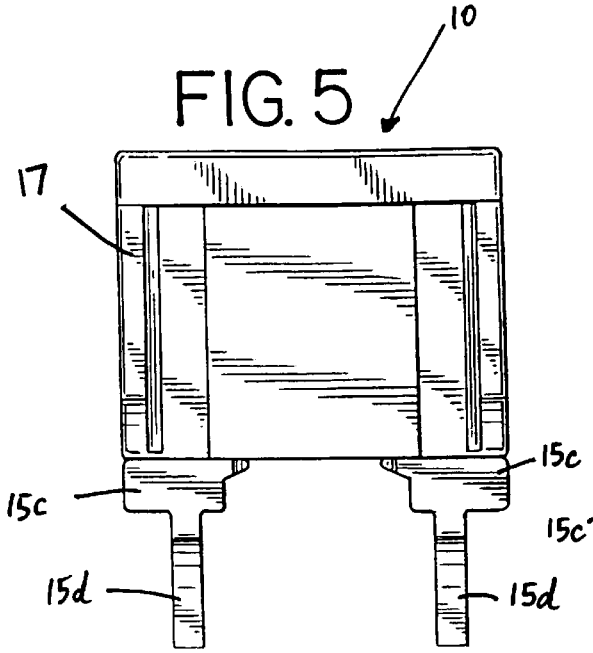
FIG. 5 is back plan view of the embodiment shown in FIG. 1.
Figure 6:
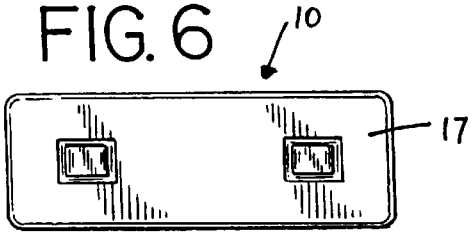
FIG. 6 is top view of the embodiment shown in FIG. 1.
Figure 7:
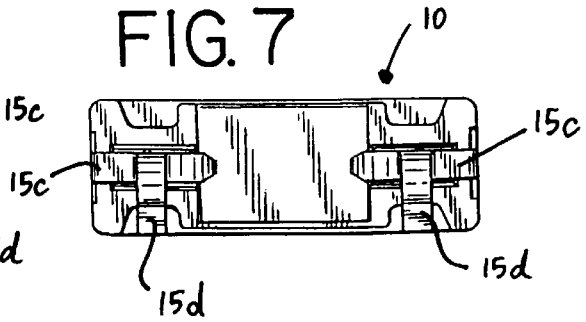
FIG. 7 is a bottom view of the embodiment shown in FIG. 1.

Specifically, the distal ends 15*b* have a first section 15*c* which is coplanar with the proximal end portion 15*a*. The first sections 15*c* have a width greater than the width of the openings in the bottom of the housing 17 and greater than the width of the proximal ends 15*a* of the leads 15. Extending from the first section 15*c* is an S-shaped or Z-shaped terminal extension 15*d*. Preferably, the terminal extension 15*d* has a much smaller width than the width of the first section 15*c* (e.g., 25% less, especially 50% less, or even 75% less). Referring to FIG. 4, the distal end 15*b* of the terminals 15 extend outwardly from the center of the housing 17. However, due to the S-shaped or Z-shaped terminal extension 15*d*, the outer most portion 15*b*' of the distal end 15*b* of the lead 15 lies along a different plane than the rest of the lead 15, i.e., the outer most portion 15*b*' now lies in the same plane as one of the sidewalls 17*a* of the housing 17. In this embodiment, the fuse 10 can be mounted to a surface (not shown) by placing the fuse 10 on the substrate such that the outer most portion 15*b*' of the distal end 15*b* of the lead 15 and the sidewall 17*a* of the housing rest on the substrate. In this embodiment, the outer most portions 15*b*' of the distal ends 15*b* of the leads 15 are soldered (or otherwise electrically connected) to a conductive trace on the substrate (typically a printed circuit board "PCB").

Figure 8:
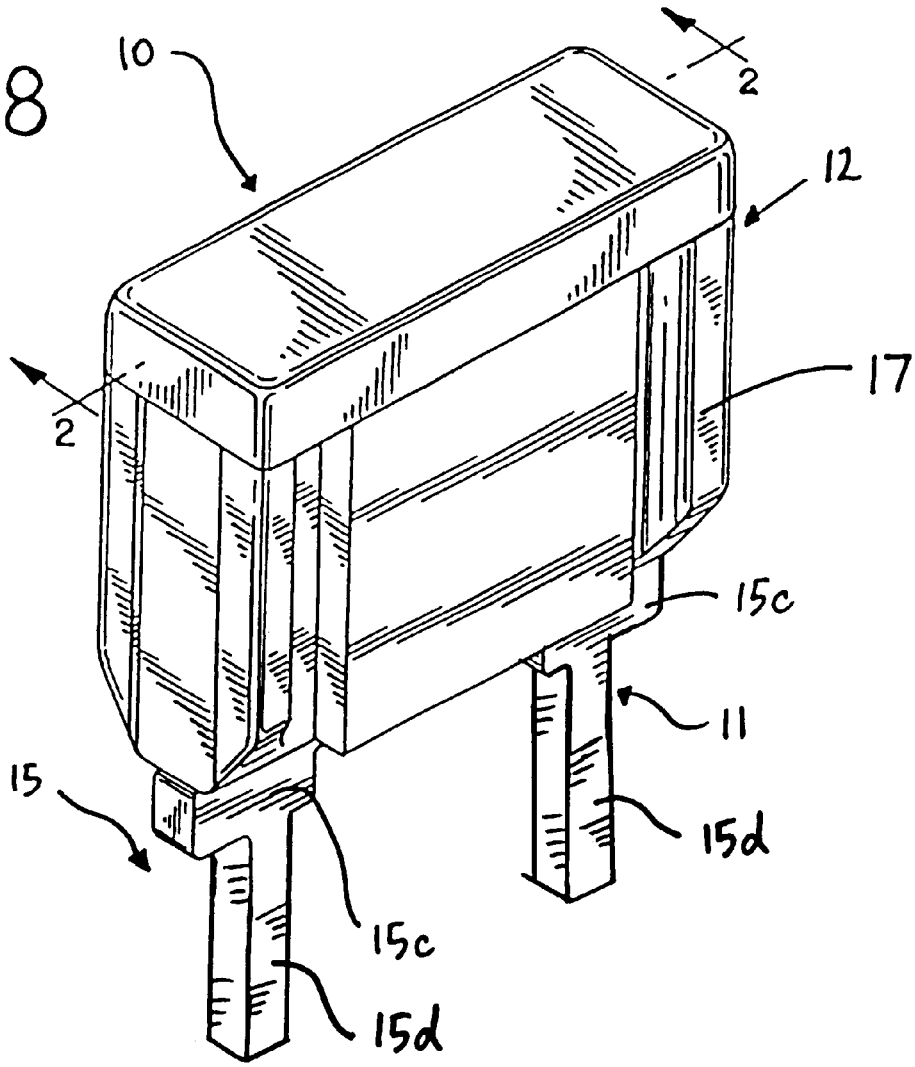
FIG. 8 is a perspective view of another embodiment of a fuse according to the present invention.

In an alternative embodiment illustrated in FIG. 8, the distal ends 15*b* have a first section 15*c* which is identical to the embodiment illustrated in FIGS. 1–8. Rather than having an S-shaped or Z-shaped terminal extension 15*d*, the terminal extension 15*d* is coplanar with the rest of the lead 15 and has a width less than the width of the rest of the lead 15 (e.g., 25% less, especially 50% less, or even 75% less). Preferably, the width is such that the terminal extension 15*d* can be placed in a conventional through-hole in a PCB and electrically connected to a conductive trace. In this embodiment, the fuse 10 is mounted "standing up" rather than resting on the PCB.

In a preferred embodiment illustrated in FIG. 2, the fusible link 16 and the terminal leads 15 are punched from a single conductive metal strip such as disclosed in U.S. Pat. Nos. 4,023,265, 4,131,869 and 4,635,023, the disclosures of which are incorporated herein by reference. Alternatively, the terminal leads may be electrically connected by a separate member (e.g., piece of wire made from a conductive metal, or some other conductive material).

The preferred material for use on the housing 17 of the present invention should meet specific requirements. This material should have satisfactory mean values for two specific electrical properties and three specific flammability properties. The electrical properties of concern include the arc resistance and the comparative tracking index (CTI) of the material. The flammability properties considered include the high-amperage arc ignition resistance, the high-voltage arc tracking rate, and the hot wire ignition value of the material.

A material which meets or exceeds the desired property values of the fuse housing is called RYNITE™ PET thermoplastic polyester resin by Du Pont. RYNITE™ is the family name for a number of polyethylene terephthalate (PET) resins which contain uniformly dispersed glass fibers or mineral/glass fiber combinations. These PET resins have been specially formulated for rapid crystallization during the injection molding process. This family of materials offers a unique combination of high strength, stiffness, excellent dimensional stability, outstanding chemical and heat resistance, and good electrical properties. Specifically, RYNITE™ 415HP NC010 is the most preferred thermoplastic resin, having a 15% glass reinforced modified polyethylene terephthalate. Other possible grades may include glass fiber contents within the range of from about 0% to about 70%.

It is anticipated, however, that an insulative material which meets or exceeds the preferred property standards as set forth herein, would be acceptable for use for the housing of the present invention. Nylon materials (various grades) have also been found to exhibit suitable characteristics. It is believed that the disclosed test methods and the disclosed preferred resulting test values best indicate suitable material for use in the fuse housing of the present invention. The present disclosure is not intended to eliminate other possible test methods nor other possible property parameters which may exist and which may equally indicate the suitability of a material for the fuse housing of the present invention. In fact, other materials which burn cleanly and have improved ablative qualities in high energy periods may be suitable for use in the present invention.

Material Test Methods and Parameters

The test method for the determination of the effects of high-voltage, low current, dry arc resistance of solid electrical insulation is described in the *Standard Test Method for High-Voltage, Low-Current, Dry Arc Resistance of Solid Electrical Insulation*, ASTM D 495–84. In this test, a mean time of arc resistance is determined.

The arc-resistance test is intended to approximate service conditions in alternating-current circuits operating at high voltage and with currents generally limited to less than 0.1 amperes. The test method seeks to exclude complicating factors such as dirt and moisture and other contaminants.

After conditioning (ambient conditions within the range of 15° C. to 35° C. (59° F. to 95° F.) and 45% to 75% relative humidity), the specimen is placed in an electrode holder assembly. An adjustable transformer is then adjusted to provide 12,500 Volts. A test sequence is then followed whereby the specimen is subjected to an increase in the severity of arcing (See TABLE 1.1). This is accomplished by first increasing the duration of the arc, and later by increasing the current. The arc resistance of the material is determined by the total elapsed time of arcing exposure until tracking occurs.

TABLE 1.1

Sequence of 1-minute Current Steps

| Step | Current (mA) | Time Cycle[a] (sec.) | Total Time (sec.) |
|---|---|---|---|
| ⅛-10 | 10 | ¼ on, 1-¾ off | 60 |
| ¼-10 | 10 | ¼ on, ¾ off | 120 |
| ½-10 | 10 | ¼ on, ¼ off | 180 |
| 10 | 10 | continuous | 240 |
| 20 | 20 | continuous | 300 |
| 30 | 30 | continuous | 360 |
| 40 | 40 | continuous | 420 |

[a]In the earlier steps, an interrupted arc is to be used to obtain a less severe condition than the continuous arc; a current of less than 10 mA produces an unsteady (flaring) arc.

The preferred material of the present invention has an arc resistance, as determined by the above testing method, within the range of 60 to 120 seconds.

The test method for determining the comparative tracking index (CTI) of electrical insulation materials is performed under the conditions specified in the Standard Test Method for Comparative Tracking Index of Electrical Insulation Materials, ASTM D 3638–85 (IEC 112). The tracking index (TI) is the voltage that causes a permanent electrically conductive carbon path with the application of 50 drops of electrolyte to the specimen, applied at the rate of one drop every 30 seconds. The surface of the specimen is subjected to a low-voltage alternating stress combined with a low current and maintained across the insulation until the current flow exceeds a predetermined value. The test measure of the susceptibility of the material to tracking.

Based on the TI, the specimen material is assigned a Comparative Tracking Performance Level Category (PLC) as shown in TABLE 1.2 below.

TABLE 1.2

Comparative Tracking Performance Level Categories (PLC)

| Tracking Index Range (volts) | PLC |
|---|---|
| 600 ≦ TI | 0 |
| 400 ≦ TI < 600 | 1 |
| 250 ≦ TI < 400 | 2 |
| 175 ≦ TI < 250 | 3 |
| 100 ≦ TI < 175 | 4 |
| 0 ≦ TI ≦ 100 | 5 |

The preferred material of the present invention has a tracking index, as determined by the above testing method, within the range of 250 to 400 volts (PLC=2).

The purpose of the high-voltage, arc-tracking rate of solid insulating materials test is to determine the susceptibility of the test specimen to track or form a visible carbonized conducting path over the surface when subjected to high-voltage, low-current arcing. The susceptibility is measured is millimeters per minute (mm/min).

The high-voltage arc-tracking rate is the rate in millimeters per minute at which a conducting path can be produced on the surface of the material under standardized test conditions (as described earlier). The test determines the ability of the material to withstand repeated high-voltage low-current arcing at its surface without forming a conductive path—a simulation of conditions that might be encountered during malfunction of a high-voltage power supply.

The basic components of the high-voltage arc-tracking rate test apparatus include:

a) A power transformer rated 250 VA minimum primary 120 VA A-C, root mean square (VAC RMS) 60 Hz; secondary open-circuit volts 5200 VAC RMS;

b) A current-limiting resistor bank (with a variable nominal resistance of 2.2 megohms) capable of limiting the short-circuit current at the electrodes to 2.36 mA;

c) Two test electrodes consisting of a No. 303 stainless steel rod having a diameter of 3.2 mm (⅛ a inch) and an overall length of approximately 102 mm (4 inches). The end should be machined to a symmetrical conical point having an overall angle of 30°. The radius of curvature for the point should not exceed 0.1 mm at the start of the given test. During the test, the electrodes are to be mounted in a common vertical plane, parallel to the axis of the test specimen, orthogonal to one another, and should have an angle of 45° to the horizontal such that their tips contact the surface of the specimen with a normal force of 0.20±0.04 N (20.4±4.0 gf). One of the electrodes should be fixed and the other movable in a horizontal direction to increase the length of the air gap between electrodes, while maintaining the 45° angle;

d) A timer should preferably be incorporated in the test fixture so that the operator can record the length of time of the test; and e) The circuit shown in the diagram below:

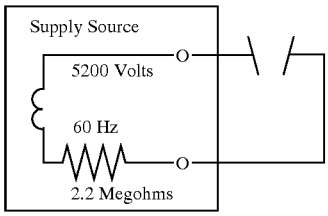

Voc=open circuit-voltage=5,200 volts

Isc=short-circuit current=2.36 milliamperes

The specimens for testing are preferably bars of about 5 inches (127 mm) long and 0.5 inches (12.7 mm) wide. For a standard comparison of materials, each specimen should be about 3.18±0.25 mm (0.125±0.010 inch) thick. Thin materials are to be tested by first clamping them together to form a specimen as close to 3.2 mm (⅛ inch) thick as possible. All specimens should be tested at 23.0±2.0° C. (73.4±3.6° F.) and 50±5% relative humidity. All specimens should be maintained at the test conditions for a minimum of 40 hours prior to testing.

Each test specimen should be clamped in position under the electrodes. The electrodes are to be placed on the surface of the test sample and spaced 4.0 mm (0.16 inch) from tip to tip. The circuit is then to be energized. As soon as the arc track appears on the surface of the sample, the movable electrode is to be drawn away as quickly as possible while maintaining the arc tracking. If the arc extinguishes, the spacing between electrodes is to be shortened as quickly as possible until the arc is reestablished. Immediately following the reestablishment of the arc, the electrodes are again withdrawn as quickly as possible. This process is to be repeated for 2 minutes of accumulated arcing time. The length of the conductive path or track is measured and the tracking rate is to be determined by dividing the length of the path in millimeters by the two minute arcing time. Any ignition of the test sample, or a hole burned through the sample, should be recorded.

A Performance Level Category (PLC) is assigned to the material based on the determined tracking rate (TR), and in accordance with the values shown in TABLE 1.3 below.

TABLE 1.3

High-Voltage Arc-Tracking-Rate Performance Level Categories (PLC)

| Tracking Rate Range (mm/min) | PLC |
|---|---|
| 0 < TR ≦ 10 | 0 |
| 10 < TR ≦ 25.4 | 1 |
| 25.4 < TR ≦ 80 | 2 |
| 80 < TR ≦ 150 | 3 |
| 150 < TR | 4 |

The preferred material of one embodiment of the present invention has a tracking rating within the range of 25 to 80.

The test method for the determination of resistance to ignition of plastic materials from an electrically heated wire is described in the Standard Test Method for Ignition of Materials by Hot Wire Sources, ASTM D 3874–88.

Under certain conditions of operation or malfunctioning of electrical equipment, fuses, as well as wires, other conductors, resistors, or other parts may become abnormally hot. When these overheated parts are in intimate contact with insulating materials, such as the fuse housing, the insulating materials may ignite. The Hot Wire Ignition Test is intended to determine the relative resistance of insulating materials to ignition under such conditions.

For a given material, the resistance to ignition is measured in the Hot Wire Ignition Test in seconds (sec.). A Performance Level Category (PLC) is assigned the material based on the ranges shown in TABLE 1.4 below.

TABLE 1.4

Hot Wire Ignition Performance Level Categories (PLC)

| Mean Ignition Time Range (sec) | PLC |
|---|---|
| 120 ≦ IT | 0 |
| 60 ≦ IT < 120 | 1 |
| 30 ≦ IT < 60 | 2 |
| 15 ≦ IT < 30 | 3 |
| 7 ≦ IT < 15 | 4 |
| 0 ≦ IT < 7 | 5 |

The preferred material of one embodiment of the present invention has a hot wire ignition time greater than 120 seconds.

The final material test is called the High-Current Arc Ignition Test. The method of the test is useful in differentiating among solid insulating materials with regard to resistance to ignition from arcing electrical sources.

Under certain normal or abnormal operation of electrical equipment, insulating materials might be in proximity to arcing. If the intensity and duration of the arcing are severe, the insulating material can become ignited. This test is intended to simulate such a condition.

Accordingly, the basic components of the test apparatus include:

a) A fixed electrode—A copper rod that is 3.2 mm (⅛ inch) in diameter and has an overall length of approximately 152 mm (6 inches) is to be used. One end is to be machined to a symmetric chisel point having a total angle of 30°. The radius of curvature for the chisel edge is not to exceed 0.1 mm (0.004 inch) at the start of a given test;

b) A movable electrode—A No. 303 stainless steel rod that is 3.2 mm (⅛ inch) in diameter and has an overall length of approximately 152 mm (6 inches) is to be used. The end is to be machined to a symmetric conical point having a total angle of 60°. The radius of curvature for the point is not to exceed 0.1 mm (0.004 inch) at the start of a given test;

c) A power source—Power is to be supplied to the test electrodes from a 240-V a-c, 60 Hz high-capacity source. A series (inductive-resistive) air-core impedance is to be provided to yield a short circuit current of 32.5 A and a power factor of 0.5;

d) a test fixture—The test sample is to be clamped horizontally on a nonconductive, fire-resistant, and inert surface. Both electrodes are to be positioned at an angle of 45° to the horizontal, in a common vertical plane, orthogonal to the axis of the sample. The chisel edge of the fixed electrode is to be horizontal and is to contact the sample throughout the test. Initially, the conical point of the movable electrode is to contact the chisel edge of the fixed electrode on the surface of the specimen. A mechanical means is to be provided to displace the movable electrode in both directions parallel to the axis of the electrode. The apparatus is to enable the electrodes to alternately make and break contact at the sample surface. A spring-loaded pneumatic device is one means of achieving this action. A further means is to be provided for adjustment of both the timing of the electrode contact and the rate of electrode separation;

e) a controlling relay—A relay is to be provided to trigger the electrode separation 1 when the electrode current has reached 32.5 A; and f) a counter—An automatic counter is to be provided to record the number of cycles throughout a given test.

The test specimen should preferably consist of a bar sample measuring 12.7 mm×127 mm (0.5×5.0 inches) by the thickness to be tested. Special conditioning of the specimen is not required.

During testing, each specimen, in turn, should be positioned with the electrodes making initial contact on the surface of the sample. The circuit should be energized and the cyclic arcing started as soon as the specimen is secured. The timing of the arcs should be adjusted to a rate of 40 complete arcs per minute. The rate of electrode separation should preferably be 254±25 mm per second (10±1 inch per second). The test is to be continued until ignition of the sample occurs, a hole is burned through the sample, or until a total of 200 cycles has elapsed.

If ignition or a hole through any specimen occurs, an additional set of three samples should be tested with the electrodes making contact 1.6 mm (1/16 inch) above the surface of the specimen. If ignition or a hole occur within 200 cycles, an additional set of three samples should be tested with the electrodes making contact 3.2 mm (⅛ inch) above the surface of the specimen.

After testing of all samples is completed, a Performance Level Category (PLC) can be assigned to the material, based on the mean number of arcs needed to cause ignition, in accordance with the ranges shown in TABLE 1.5 below.

TABLE 1.5

High-Current Arc Ignition Performance Level Categories (PLC)

| Mean Number or Arcs to Cause Ignition (NA) | PLC |
|---|---|
| 120 ≦ NA | 0 |
| 60 ≦ NA < 120 | 1 |
| 30 ≦ NA < 60 | 2 |
| 15 ≦ NA < 30 | 3 |
| 0 ≦ NA < 15 | 4 |

The preferred material of the present embodiment has a NA value of greater than 120 arcs to cause ignition.

These five tests assist in determining whether a material is suitable for use as a high-voltage fuse housing in accordance with the present invention. While it is impossible to test and list all materials which may be acceptable, the desired properties of the material are disclosed. At present, RYNITE™ and nylon are materials known to the inventors which have these properties. Polysulfone and polycarbonate are materials conventionally used for insulative housings in lower voltage fuses. Polysulfone and polycarbonate are not suitable materials for the housing of fuses made according to the present invention. To the extent that other materials are found suitable, it is intended that each should fall within the scope of the appended claims.

Referring now to FIGS. 3–7, the insulative component of fuse 10 can be more readily seen. This component is comprised of a housing 17. In the present embodiment, housing 17 is preferably made from RYNITE™ PET thermoplastic polyester resin made by E. I. Du Pont, and most preferably from the Du Pont RYNITE™ 415HP NC010 grade material, in an injection molding process. The purpose of housing 17 is to insulate the electric component 11 of fuse 10 from other components to prevent arcing. The housing 17 also helps to dissipate heat from the fusible element 16 (FIG. 2), to prevent premature "burn-up."

RYNITE™ 415HP is a material which burns very cleanly—producing no carbon tracking—and contains no halogenated material to produce arc-generating halogen ions when the housing material ablates at high voltages. Ablating is the process by which a material is vaporized to form an ion plasma comprised of that material. Where halogen ions are present, the arcing process is accelerated in the plasma. Halogens are typically added to polymers used in electrical components as a flame-retardant. RYNITE™ does not contain halogens.

The desired properties of RYNITE™ 415HP NC010 are shown in TABLE 2 below.

TABLE 2

RYNITE ™ 415HP NC010 Properties

| Property | Value | Units |
|---|---|---|
| Arc Resistance | 60–120 | seconds |
| Comparative Tracking Index | 250–400 | Volts |
| High-Amperage, Arc-Ignition Resistance | >120 | arcs |
| High-Voltage Arc-Tracking Rate | 25–80 | mm/min seconds |
| Hot Wire Ignition | >120 | |

FIG. 2 shows housing 17 having a cavity 18 for holding the electric component 11 of the present invention. A hinged segment of housing (not shown) may be used to close and lock in place over cavity 18. The hinged segment may be a sidewall, top portion, or bottom portion of housing 17, the only requirement being that the opening created by the hinged segment must allow the insertion of the electric element 11 into housing 17. Such a design requires the housing material to have suitable mechanical properties as well.

The punched-out metal element is then inserted into the cavity 18 of housing 17, leaving the terminal leads 15 extending from the housing 17 and the fusible link 16 completely encased. Cavity 18 may be narrow enough to frictionally engage the metal component at various points, or molded tabs 19 (FIG. 2) may be used to engage terminal leads 15. The hinged segment may then be snapped closed over the opening (not shown) to enclose the fusible link 16.

Terminal leads 15 of the fuse are then trimmed (See FIG. 8) or trimmed and bent, as shown in FIG. 4, to form the final surface-mount fuse. The fuses shown are capable of being surface-mounted to a PCB. By employing a housing according to the present invention, a conventional blade-style automotive plug-in fuse having a 32 volt rating has been rated at 300 volts.

Voltage rating increases within the range of two to ten times that of fuses having housings formed from polysulfone or polycarbonate may be achieved by merely using the materials having the characteristics discussed above (e.g., nylon or PET polyester) All fuse types which utilize a conductive housing may find increase voltage ratings with the use of the disclosed invention.

While specific embodiments have been illustrated and described, numerous modifications come to mind without significantly departing from the spirit of the invention, and the scope of protection is only limited by the scope of the accompanying claims.

We claim:

1. An electrical fuse comprising:

an insulative housing made from a polyethylene terephthalate resin;

wherein the housing has an arc resistance within a range of about 60 seconds to about 120 seconds;

a first lead and a second lead, each having a proximal end secured within the housing and a distal end extending from the housing; and a fusible link located within the housing and electrically connecting the first lead to the second lead.

2. An electrical fuse comprising:

an insulative housing made from a polyethylene terephthalate resin;

a first lead and a second lead, each having a proximal end secured within the housing and a distal end extending from the housing; and a fusible link located within the housing and electrically connecting the first lead to the second lead;

wherein the housing has a comparative tracking index within a range of about 250 volts to about 400 volts.

3. An electrical fuse comprising:

an insulative housing made from a polyethylene terephthalate resin;

a first lead and a second lead, each having a proximal end secured within the housing and a distal end extending from the housing; and a fusible link located within the housing and electrically connecting the first lead to the second lead;

wherein the housing has a high-amperage arc ignition resistance of greater than 120 arcs.

4. An electrical fuse comprising:

an insulative housing made from a polyethylene terephthalate resin;

a first lead and a second lead, each having a proximal end secured within the housing and a distal end extending from the housing; and a fusible link located within the housing and electrically connecting the first lead to the second lead;

wherein the housing has a high-voltage arc tracking rate within the range of about 25 to about 80 mm/minute.

5. An electrical fuse comprising:

an insulative housing made from a polyethylene terephthalate resin;

a first lead and a second lead, each having a proximal end secured within the housing and a distal end extending from the housing; and a fusible link located within the housing and electrically connecting the first lead to the second lead;

wherein the housing has a hot wire ignition value of greater than 120 seconds.

6. The fuse of claim 1, 2, 3, 4, or 5 wherein the housing comprises polyethylene terephthalate resin and a filler of either glass fibers or a mineral/glass fiber combination.

7. The fuse of claim 6 wherein the housing comprises about 10% to about 55% by weight of one of either glass fibers or a mineral/glass fiber combination.

8. The fuse of claim 7 wherein the housing comprises preferably about 10% to about 25% by weight of one of either glass fibers or a mineral/glass fiber combination.

9. An electric fuse comprising:

a first lead and a second lead, each having a proximal end secured within a housing and a distal end extending from the housing;

a fusible link located within the housing and connecting the proximal end of the first lead to the proximal end of the second lead; and wherein the fusible link is configured to break when subjected to a maximum threshold voltage or current and the housing comprises a material configured to increase the maximum threshold voltage or current of the fusible link by a factor of at least five compared to an identical fuse having a housing formed from polysulfone and has an arc resistance within the range of about 60 to about 120 seconds.

10. The electric fuse of claim 9 wherein the housing comprises a material configured to increase the maximum threshold voltage or current of the fusible link by a factor of seven compared to the identical fuse having a housing formed from polysulfone.

11. The electric fuse of claim 9 wherein the housing comprises a material configured to increase the maximum threshold voltage or current of the fusible link by a factor of ten compared to the identical fuse having a housing formed from polysulfone.

12. The electric fuse of claim 9 wherein the housing material comprises a PET polyester resin.

13. The electric fuse of claim 12 wherein the PET polyester resin is RYNITE™.

14. The electric fuse of claim 9 wherein the housing material comprises nylon.

15. An electric fuse comprising:

a housing made from a material having a high-voltage, low-current, dry arc resistance within the range of about 60 to about 120 seconds;

a first lead and a second lead secured, each having a proximal end within the housing and a distal end extending from the housing; and a fusible link secured within the housing and connecting the proximal end of the first lead to the proximal end of the second lead.

16. The electric fuse of claim 15 wherein the housing is made from a material also having a comparative tracking index within a range of from about 250 volts to 400 volts.

17. The electric fuse of claim 16 wherein the housing is made from a material also having a high-current arc ignition resistance of greater than 120 arcs.

18. The electric fuse of claim 17 wherein the housing is made from a material also having a high-voltage arc tracking rate within a range of from about 25 mm/minute to about 80 mm/minute.

19. The electric fuse of claim 18 wherein the housing is made from a material also having a hot wire ignition value of greater than 120 seconds.

20. The electric fuse of claim 15 wherein the housing is made from a polyethylene terephthalate resin.

21. The electric fuse of claim 20 wherein the polyethylene terephthalate resin has glass fibers dispersed therein.

22. The electric fuse of claim 20 wherein the housing material has a mineral/glass fiber combination dispersed within the resin.

23. The electric fuse of claim 21 wherein the fuse housing comprises about 10% to about 55% by weight of one of either glass fibers or a mineral/glass fiber combination.

24. The electric fuse of claim 23 wherein the fuse housing comprises about 10% to about 25% by weight of one of either glass fibers or a mineral/glass fiber combination.

25. The electric fuse of claim 24 wherein the fuse housing comprises about 15% by weight of one of either glass fibers or a mineral/glass fiber combination.

26. The electric fuse of claim 15 wherein the housing material is comprised of RYNITE™.

27. The electric fuse of claim 15 wherein the housing material is comprised of nylon.

28. An electrical fuse comprising:

an insulative housing made from a nylon having an arc resistance within the range of about 60 to about 120 seconds;

a first lead and a second lead, each having a proximal end secured within the housing and a distal end extending from the housing; and a fusible link located within the housing and electrically connecting the first lead to the second lead.

* * * * *